United States Patent [19]

Baasch

[11] 4,402,250

[45] Sep. 6, 1983

[54] AUTOMATIC CORRECTION OF AIMING IN FIRING AT MOVING TARGETS

[75] Inventor: Hans-Friedrich Baasch, Zurich, Switzerland

[73] Assignee: Hollandse Signaalapparaten B.V., Hengelo, Netherlands

[21] Appl. No.: 243,959

[22] PCT Filed: Jun. 25, 1980

[86] PCT No.: PCT/NL80/00023

§ 371 Date: Feb. 26, 1981

§ 102(e) Date: Feb. 26, 1981

[87] PCT Pub. No.: WO81/00149

PCT Pub. Date: Jan. 22, 1981

[30] Foreign Application Priority Data

Jun. 29, 1979 [NL] Netherlands ..... 7905061

[51] Int. Cl.[3] ..... F41G 5/08

[52] U.S. Cl. ..... 89/41 AA; 235/412; 364/423

[58] Field of Search ..... 89/41 E, 41 EA, 41 AA, 89/41 L, 41 SW; 235/411, 412, 413, 414, 415, 235/416, 417; 343/7 G; 364/423

[56] References Cited

U.S. PATENT DOCUMENTS 3,848,509 11/1974 Corn ..... 89/41 SW 4,004,729 1/1977 Rawicz ..... 235/404

FOREIGN PATENT DOCUMENTS 374912 3/1964 Switzerland .

OTHER PUBLICATIONS

Millman et al., Pulse, Digital, and Switching Waveforms, 9-13, *Registers,* 1965, pp. 343-347.

*Primary Examiner*—Stephen C. Bentley

*Attorney, Agent, or Firm*—Robert J. Kraus

[57] ABSTRACT

In a method for automatically measuring aiming errors and correcting aiming values in the aiming and firing of ballistic weapons at moving targets the continuously supplied direction values (A', E'+σ) of a target position measurement, corrected for daily influences and for the superelevation, are compared with the aiming values (α+ε) of at least one gun (2) in a series of successive time intervals after storage of the gun aiming values (α+ε) in a memory (3) for a period corresponding with the instantaneous time of flight of the projectile (τ).

9 Claims, 3 Drawing Figures

AUTOMATIC CORRECTION OF AIMING IN FIRING AT MOVING TARGETS

BACKGROUND OF THE INVENTION

The invention relates to both a method and an apparatus for automatically measuring aiming errors and correcting aiming values in the aiming and firing of ballistic weapons at moving targets, in particular air targets.

In firing ballistic weapons at moving targets the gun aiming point is determind by the lead angle. The lead angle calculation is based on an assumed target motion during the time of flight of the projectile until reaching the target. In consequence of this, substantially large errors are incurred in the above calculation, and the gun will show deviations, i.e. aiming errors, with respect to the correct orientation to hit the target.

Various methods and apparatus for measuring gun aiming errors are known. Reference should be made for instance to the apparatus described in the Swiss patent specification 374.912. In this specification the direction values of a target coordinate measuring device are compared with time-related gun aiming values. This apparatus is provided with means for comparing these values and for temporarily storing the gun aiming values as necessary for the comparison, and with means for recording and processing the measured differences. This known apparatus is not suitable for the automatic correction of aiming values, particularly because it cannot achieve the required accuracy nor the required measurement rate and continuity.

SUMMARY OF THE INVENTION

The present invention has for its object to execute the measurement of aiming errors not only with great accuracy, but also in a rapid and defined time sequence, such that the measured aiming errors can be processed automatically in a statistical manner, resulting in correction of aiming values before firing and hence in an increase of the hitting probability.

According to the invention the method for automatically measuring aiming errors and correcting aiming values in the aiming and firing of ballistic weapons at moving targets is characterised in that the continuously supplid direction values of a target position measurement, corrected for meteorological influences and for superelevation. (Superrelevation is an added positive angle in antiaircraft gunnery that compensates for the fall of a ballistic projectile during the time of flight, because of the pull of gravity.) The corrected direction values are compared with the aiming values of at least one gun in a series of successive time intervals after storage of the gun aiming values in a memory for a period corresponding with the computed time of flight of the projectile. The successive time intervals, in which the corrected direction values of target position measurements are compared with the time-related gun aiming values, can be defined to be equal and fixed in magnitude and to be dependent upon the time of flight of the projectile.

The method according to the invention can be effected by a specific apparatus, or by any computer using a suitable computing program.

BRIEF DESCRIPTION OF THE DRAWING

The invention will now be described with reference to the accompanying figures, of which.

DESCRIPTION OF THE PREFERRED EMBODIMENTS

Figure 1:
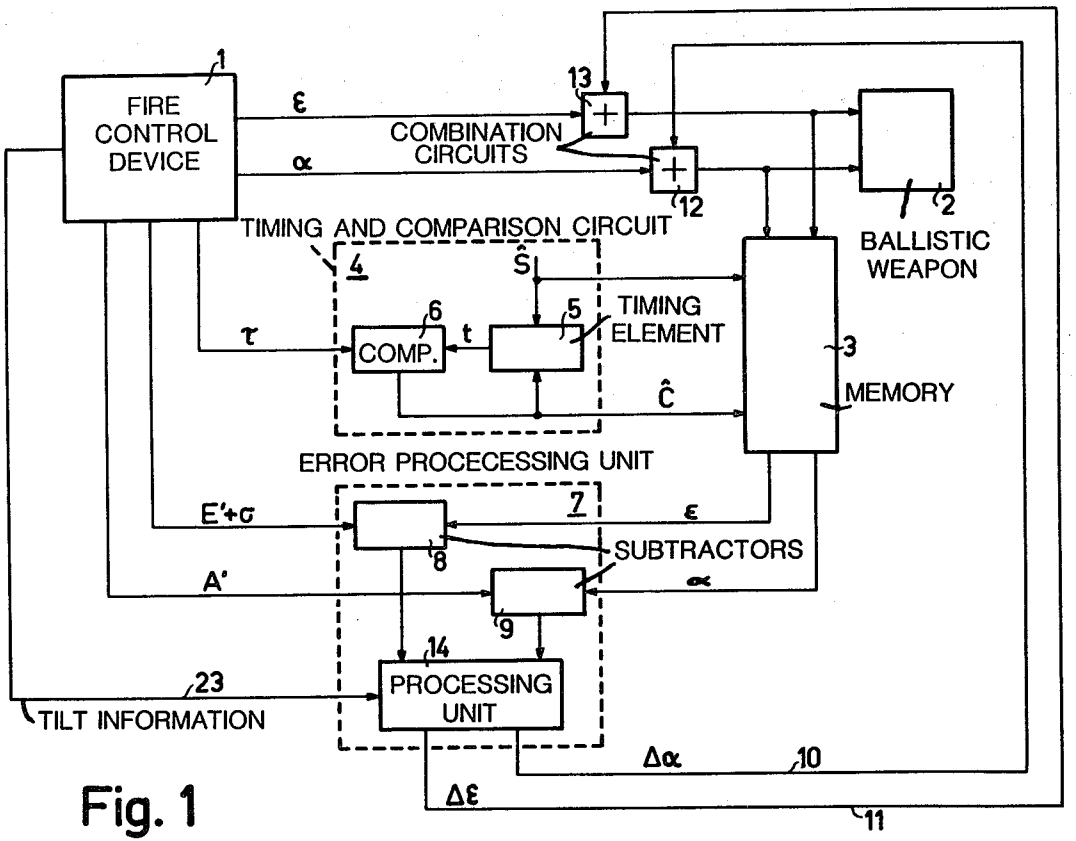
FIG. 1 is a block diagram of an apparatus for performing the method according to the invention.

In FIG. 1, the numeral 1 represents a fire control device comprising known target coordinate measuring device and computer. The target coordinate measuring device is used to continuously determine the direction values of the target, namely the azimuth angle A, the elevation angle E and the range R to the target. Also, in a known way the computer calculates a lead angle from the measured target coordinates, assuming a certain target motion. From the results of this calculation, making due corrections for meterological influences such as the effects of wind and air pressure on the flight of the projectile, the aiming values in azimuth and in elevation, $\alpha$ and $\epsilon$ respectively, are determined for one or a plurality of guns. Furthermore, the computer continually determines the computed time of flight $\tau$ of the projectile, correcting the direction values of the target A and E for meteorological influences and correcting the elevation angle E for the superelevation $\sigma$. In summarising, the fire conrol device 1 continuously supplies corrected direction values A' and $E'+\sigma$ of a target position measurement, corrected for meteorological influences and for superelevation, the aiming values $\alpha$ and $\epsilon$ of at least one gun, and the computed time of flight $\tau$ of the projectile.

The aiming values $\alpha$ and $\epsilon$ are supplied to at least one gun or other ballistic weapon 2 and to a memory 3. The apparatus according to the invention further comprises a timing and comparison circuit 4. In FIG. 1 this circuit consists of a timing element 5 and a comparator 6. Timing element 5, which may consist of a digital clock, can be initiated by a pulse $\hat{S}$, supplied by gun 2 or otherwise generated, for example manually, to apply the time value t, measured from that instant, to comparator 6. The gun aiming values $\alpha$ and $\epsilon$ must be kept in memory 3 for a period corresponding with the computed time of flight $\tau$ of the projectile. This is achieved by applying pulse $\hat{S}$ to both the timing element 5 and to memory 3. Pulse $\hat{S}$ thus initiates timing element 5 simultaneously with the storage of gun aiming values $\alpha$ and $\epsilon$ into memory 3. On the expiration of the time of flight $\tau$ of the projectile, a second pulse $\hat{C}$ reads the memory-stored gun aiming values out of memory 3. This second pulse $\hat{C}$ is generated as soon as time t applied to comparator 6 is equal to the time of flight $\tau$ supplied by fire control device 1. The timing element can be reset with pulse $\hat{C}$ at the same time.

The gun aiming values $\alpha$ and $\epsilon$ read from memory 3 on the expiration of the time of flight $\tau$ of the projectile can then be compared with the target direction values A' and $E'+\sigma$ in the correct time relationship. The target direction values A' and $D'+\sigma$ and the gun aiming values $\alpha$ and $\epsilon$ are supplied to an error processing unit 7. This unit comprises two subtracters 8 and 9 for comparing the time-related target direction values and gun aiming values in pairs. The subtraction process renders the angle differences $\Delta\alpha=\alpha-A'$ and $\Delta\epsilon=\varepsilon-(E'+\sigma)$, which represent gun aiming errors in azimuth and elevation.

The angle differences $\Delta\alpha$ and $\Delta\epsilon$ can be directly applied for closed-loop correction by transmitting them to gun 2 over lines 10 and 11 and combining them there or, as illustrated in FIG. 1, can be combined with the aiming values supplied by fire control device 1 in combination circuits 12 and 13, respectively.

Repetitive execution of this correction method could however result in an amplitude build-up of the aiming errors if no special measures were taken, i.e. if no corrections were made, taking into account the different components of the aiming errors. The error processing unit 7 therefore contains a data recording and processing unit 14, in which the angle differences from subtracters 8 and 9 are recorded and statistically processed to adapt the gun aiming errors, applied to gun 2 via lines 10 and 11, to the specific characteristics of the fire control device 1.

Figure 2:
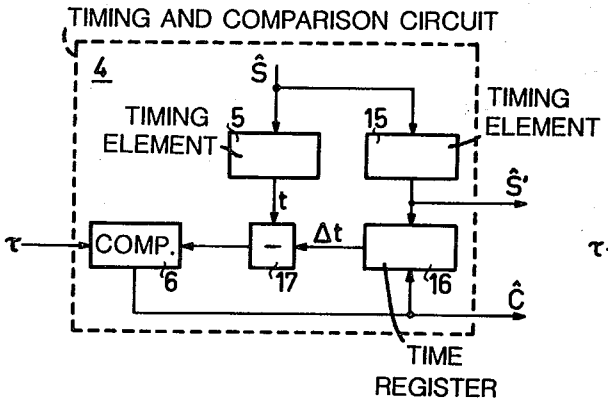

Th statistical processing and the analysis of the angle differences $\Delta\alpha$ and $\Delta\epsilon$ in the data recording and processing unit 14 is achieved through an automatically repeating process of storing gun aiming values and determining aiming errors $\Delta\alpha$ and $\Delta\epsilon$ in a series of short time intervals. Such an automatic determination of successive gun aiming errors $\Delta\alpha$ and $\Delta\epsilon$ is accomplished by using the timing and comparison circuit 4 illustrated in FIG. 2. In this embodiment the timing and comparison circuit comprises, in addition to the (first) timing element 5 and comparator 6, a second timing element 15, a time register 16 and a subtracter 17. The expiration of a selectable time interval $\Delta t$ can be established by the second timing element 15. After a first pulse $\hat{S}$ is initiated by gun 2 or is otherwise generated, for instance manually, and after each expiration of a time $\Delta t$, the second timing element 15 automatically delivers a pulse $\hat{S}'$ for storing gun aiming values $\alpha$ and $\epsilon$. The $\hat{S}'$ pulses are also fed to the time register 16 to supply subtracter 17 with each time $\Delta t$ present in this register. In subtracter 17 time $\Delta t$ is subtracted from time t of timing element 5 with each $\hat{S}'$ pulse. Timing element 5 continues counting between the appearance of the S pulses. The time value established in subtracter 17 is subsequently applied to comparator 6. Each time the comparator 6 establishes that the time value from the subtracter is equal to $\tau$, a pulse C is generated for reading out the particular aiming values. The C pulse is also used to activate time register 16; this register is not to pass time $\Delta t$ to the subtracter until the comparator has established an equivalence for the first time. The aiming error analysis performed in the data recording and processing unit 14 can be realised in different ways, without deviating from the scope of the present invention. A particularly simple method lies in the determination of an average aiming error over a time interval of one or several seconds. It will be clear that the process executed in timing and comparison circuit 4 and in the aiming error processing unit 7 can be achieved in any computer with a suitable program.

Figure 3:
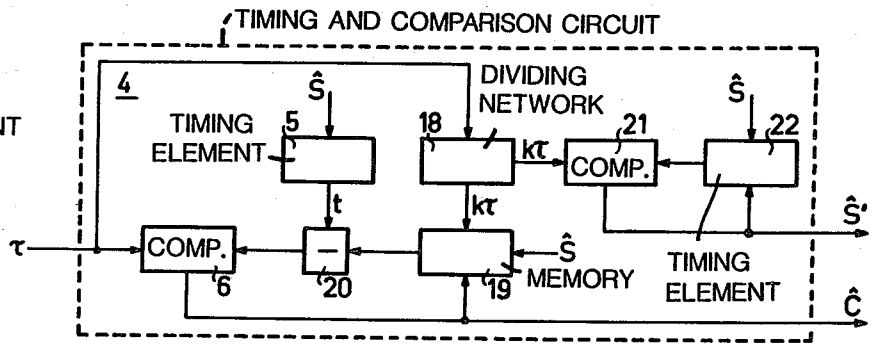
FIGS. 2 and 3 show different embodiments of a part of this apparatus.

The rapid and defined timing sequence of the various aiming error measurements made in accordance with the present invention enable continuous correction of the gun aiming values to effect automatic "closed-loop" firing. With the method of closed-loop firing, as explained with reference to the apparatus of FIG. 1, gun aiming errors incurred when firing at moving targets can often be reduced. In the automation of closed-loop firing, i.e. the automatic correction process of the aiming values at a relatively high rate, as described with reference to FIG. 2, a further reduction in gun aiming errors can be achieved. Referring to FIG. 3, it will now be described how this correction process can be optimized. Optimization of the aiming value correction process is achieved by using the timing and comparison circuit 4, whereby the recording of aiming values no longer occurs in regular time intervals but in time intervals which each equal a respective projectile's time of flight to the target, or a defined fraction thereof. This time of flight varies continuously in accordance with the target motion, while the readout of the stored aiming values is maintained on the expiration of the projectile's time of flight. The timing and comparison circuit of FIG. 3 comprises, in addition to the (first) time element 5 and the (first) comparator 6, a dividing network 18, a memory 19, a subtracter 20, a second comparator 21 and a second timing element 22. The automatic correction process of the aiming values is again initiated by a pulse $\hat{S}$ supplied by gun 2 or is otherwise generated, for instance manually. The $\hat{S}$ pulse is applied to timing elements 5 and 22 and to memories 3 and 19. In memory 3 this pulse is used for storing the instantaneous gun aiming values $\alpha$ and $\epsilon$ and in memory 19 for storing the instantaneous fractional value $k\tau$ of the projectile's time of flight determined in network 18. In comparator 21 the time value of timing element 22, which continuously increases from zero, is compared with the fractional value $k\tau$ of the projectile's time of flight varying continuously in accordance with the target motion. As soon as the difference in comparator 21 is zero, a pulse $\hat{S}'$ is generated and applied to memory 3 for storing the gun aiming values supplied at that instant and to the second timing element 22 for resetting the time value contained therein to zero. After resetting the time value in the second timing element 22 immediately starts to increase again until it reaches equivalence with the value $k\tau$ in comparator 21, so that a new pulse $\hat{S}'$ is produced and the above process is repeated. In comparator 6 the time value of timing element 5, which continuously increases from zero, is compared with the time of flight $\tau$ varying continuously in accordance with the target motion. As soon as the difference in comparator 6 is zero, a pulse $\hat{C}$ is generated and applied to the two memories 3 and 19. In memory 3 the $\hat{C}$ pulse is used for reading out the relevant gun aiming values and in memory 19 for reading out the relevant fractional value $k\tau$ of the projectiles time of flight. The values read from the two memories are delayed with respect to the time of their storage, the delay interval corresponding with the time of flight $\tau$.

In subtracter 20 the fractional value $k\tau$ of the time of flight read from memory 19 is subtracted from time t applied by timing element 5 at that instant, where t corresponds with the full time of flight $\tau$. The time $t-k\tau$ immediately starts to increase again, until time equivalence is again reached between the time values applied to comparator 6, causing the generation of another pulse $\hat{C}$, and the above process is repeated.

The gun aiming values read from memory 3 during the C pulse are again applied to the error processing unit 7, where they are compared with the direction values $A'$ and $E'+\sigma$ supplied by fire control device 1 at the same time. After comparison the gun aiming errors obtained can be processed statistically and the correction values so derived can be fed to gun 2.

Although the gun aiming values are recorded at different times, the application of the readout pulses generated at still other times for reading out the correct gun aiming values does not present any difficulties. Since shift registers are used to build up the memory, the timing of the read-out aiming values corresponds with the timing of the stored aiming values (first-in, first-out), thus maintaining the correct readout sequence. In summarising, it should be noted that with the aid of the apparatus according to the invention the gun aiming data can be corrected automatically be executing the correction process in rapid successive time intervals. These time intervals may be fixed or variable in magnitude and may particularly correspond with a fraction of the continuously changing time of flight of the projectile. The latter choice is of special advantage for reaching optimal correction of the aiming values. A special case is obtained when in the apparatus according to the invention the full time of flight of the projectile is taken as time interval instead of a fraction of the time of flight; this will in no way affect the performance of the apparatus in question.

The invention entails that the embodiment of the various components making up the apparatus in question is of minor consideration. The various components can be realised with different switching and computing techniques. Also, the invention can be realised with the aid of a suitable program in any computer.

Although only one gun is indicated in FIG. 4, it is obvious that the gun aiming values of several guns can be compared with the target direction values of one single target coordinate measuring device. With several guns the parallax arrangement of the guns and the target coordinate measuring device should be taken into account in the conventional way.

It should finally be noted that the method for automatically measuring gun aiming errors and correcting gun aiming values is applicable to both a stationary and a moving apparatus. The latter case requires a continuous determination of the instantaneous tilt of the apparatus. The direction values A′ and $E'+\sigma$ and the aiming values $\alpha$ and $\epsilon$ from the first control device 1 must then be corrected for the instantaneous tilt of the apparatus. Also the motion of the apparatus must be which each equal a respective projectile's time of considered in the statistical aiming error process performed by the data recording and processing unit 14. Information relating to this tilt is transmitted from the fire control device to the processing unit by the line 23.

I claim:

1. A method for correcting aiming errors of a ballistic weapon which is aimed at a moving target in response to changing azimuth values $\alpha$ and elevation values $\epsilon$ received from a fire control device, said method comprising the steps of:

(a) continually storing the instantaneous azimuth and elevation values received by the ballistic weapon;

(b) measuring the present azimuth A and elevation E of the target;

(c) computing a corrected azimuth A′ and elevation $E'+\sigma$ of a position at which a projectile fired by the ballistic weapon should have been aimed to account for meteorological influences and superelevation;

(d) computing a projectile's time of flight $\tau$ to said position from the ballistic weapon;

(e) comparing the corrected azimuth A′ and elevation $E'+\sigma$ with the respective azimuth value $\alpha$ and elevation value $\epsilon$ which was stored for a period corresponding to the time of flight $\tau$, and determining differences representing aiming errors $\Delta\alpha$ and $\Delta\epsilon$, respectively; and (f) adjusting the aim of the ballistic weapon to correct for the errors $\Delta\alpha$ and $\Delta\epsilon$.

2. A method as in claim 1 wherein the interval between successive comparisons of the corrected azimuth A′ and elevation $E'+\sigma$ with the respective azimuth value $\alpha$ and elevation value $\epsilon$ is equal to the computed time of flight $\tau$.

3. A method as in claim 1 wherein the interval between successive comparisons of the corrected azimuth A′ and elevation $E'+\sigma$ with the respective azimuth value $\alpha$ and elevation value $\epsilon$ is less than the computed time of flight $\tau$.

4. A method as in claim 1, 2 or 3 where said differences are statistically processed to produce said aiming errors.

5. A method as in claim 4 employing programmable digital signal processing to effect said statistical processing.

6. An apparatus for correcting aiming errors of a ballistic weapon adapted for aiming at a moving target in response to changing azimuth values $\alpha$ and elevation values $\epsilon$, said apparatus comprising:

(a) a fire control device for supplying the values $\alpha$ and $\epsilon$ to the ballistic weapon, said device including means for measuring the present azimuth A and elevation E of the target, means for computing a corrected azimuth A′ and elevation $E'+\sigma$ of a position at which a projectile fired by the ballistic should have been aimed to account for meteorological influences and superelevation, and means for computing the time of flight $\tau$ of said projectile from the ballistic weapon to said position;

(b) an aiming value memory for storing the instantaneous azimuth and elevation values supplied to the ballistic weapon;

(c) a timing means for effecting reading out from the memory the azimuth value $\alpha$ and elevation value $\epsilon$ which was stored for a period corresponding to the time of flight $\tau$;

(d) an error processing unit for receiving the corrected azimuth A′ and elevation $E'+\sigma$ computed by the fire control device and comparing them with the respective azimuth value $\alpha$ and elevation value $\epsilon$ read out from memory, and determining differences corresponding to aiming errors $\Delta\alpha$ and $\Delta\epsilon$, respectively; and (e) means for adjusting the aim of the ballistic weapon in response to $\Delta\alpha$ and $\Delta\epsilon$ to correct for said aiming errors.

7. An apparatus as in claim 6 where the timing means comprises:

(a) means for producing an initiation signal $\hat{S}$;

(b) a timing element triggered by the initiation signal S for producing a time value t representative of the time elapsed since triggering; and (c) a comparator for comparing the time value t with the computed time of flight $\tau$ and, upon equivalence, producing a signal $\hat{C}$ for resetting the time element and reading out from memory the azimuth value $\alpha$ and the elevation value $\epsilon$ corresponding to the corrected azimuth A′ and elevation $E'+\sigma$ then being received by the error processing unit.

8. An apparatus as in claim 6 where the timing means comprises:

(a) means for producing an initiation signal $\hat{S}$;

(b) a first timing element triggered by the initiation signal $\hat{S}$ for producing a time value t respresentative of the time elapsed since triggering;

(c) a second timing element triggered by the initiation signal $\hat{S}$ for repeatedly producing a signal $\hat{S}'$ at intervals $\Delta t$ after triggering, each signal $\hat{S}'$ effecting storage in the memory of the values $\alpha$ and $\epsilon$ then being supplied to the ballistic weapon;

(d) a time register for producing a signal representing $\Delta t$ each time a signal $\hat{C}$ is applied thereto;

(e) a subtractor coupled to the first timing element and the time register for decreasing the time value t by $\Delta t$ each time the signal $\hat{C}$ is applied to the time register; and (f) a comparator for comparing the time value t with the computed time of flight $\tau$ and, upon equivalence, producing said signal $\hat{C}$, effecting reading out from memory the azimuth value $\alpha$ and the elevation value $\epsilon$ corresponding to the corrected azimuth $A'$ and elevation $E'+\sigma$ then being received by the error processing unit.

9. An apparatus as in claim 6 where the timing means comprises:

(a) means for producing an initiation signal $\hat{S}$;

(b) a first timing element triggered by the initiation signal $\hat{S}$ for producing a time value t representative of the time elapsed since triggering;

(c) a dividing network for determining a fractional value $k\tau$ from the computed time of flight $\tau$;

(d) a time memory for storing the instantaneous value $k\tau$ when the initiation signal $\hat{S}$ is produced, and for producing the stored value $k\tau$ each time a signal $\hat{C}$ is applied thereto;

(e) a subtractor coupled to the first timing element and the time memory for decreasing the time value t by $k\tau$ each time the signal $\hat{C}$ is applied to the time memory;

(f) a first comparator for comparing the time value t with the computed time of flight $\tau$ and, upon equivalence, producing the signal $\hat{C}$;

(g) a second timing element triggered by the initiation signal $\hat{S}$, for producing a continually increasing time value which is repeatedly reset to zero by a signal $\hat{S}'$; and (h) a second comparator for comparing the time value produced by the second timing element with the fractional value $k\tau$ determined by the dividing network and, upon equivalence, producing the signal $\hat{S}'$;

each signal $\hat{S}'$ effecting storage in the aiming value memory of the values $\alpha$ and $\epsilon$ then being supplied to the ballistic weapon, and each signal $\hat{C}$ effecting reading out from the aiming memory the azimuth value and the elevation corresponding to the corrected azimuth $A'$ and elevation $E'+\sigma$ then being received by the error processing unit.

* * * * *